US007877054B1

(12) United States Patent
Thayer et al.

(10) Patent No.: US 7,877,054 B1
(45) Date of Patent: Jan. 25, 2011

(54) PROCESS FOR DEVELOPMENT OF CLEANING BLADE LUBRICATION STRIPES

(75) Inventors: Bruce Earl Thayer, Spencerport, NY (US); Aaron Michael Burry, Ontario, NY (US); Michael F. Zona, Holley, NY (US)

(73) Assignee: Xerox Corporation, Norwalk, CT (US)

( * ) Notice: Subject to any disclaimer, the term of this patent is extended or adjusted under 35 U.S.C. 154(b) by 31 days.

(21) Appl. No.: 12/502,445

(22) Filed: Jul. 14, 2009

(51) Int. Cl.
*G03G 21/00* (2006.01)

(52) U.S. Cl. ..... 399/346; 399/350

(58) Field of Classification Search ..... 399/343–346, 399/350; 15/1.51, 256.5; 427/145, 180, 427/430.1; 430/125
See application file for complete search history.

(56) References Cited

U.S. PATENT DOCUMENTS

| | | | | |
|---|---|---|---|---|
| 5,463,455 | A | 10/1995 | Pozniakas et al. | |
| 6,775,511 | B2 | 8/2004 | Kosuge | |
| 6,778,805 | B2 * | 8/2004 | Kai et al. | 399/346 |
| 7,362,996 | B2 | 4/2008 | Facci et al. | |
| 2004/0131381 | A1 | 7/2004 | Kawasumi et al. | |
| 2006/0291885 | A1 | 12/2006 | Radulski | |
| 2008/0013978 | A1 | 1/2008 | Facci et al. | |
| 2009/0110416 | A1 | 4/2009 | Thayer et al. | |
| 2009/0129793 | A1 | 5/2009 | Milton et al. | |

FOREIGN PATENT DOCUMENTS

| | | | |
|---|---|---|---|
| JP | 2006208418 | * | 8/2006 |

* cited by examiner

*Primary Examiner*—Hoan Tran
(74) *Attorney, Agent, or Firm*—Ronald E. Prass, Jr.; Prass LLP

(57) ABSTRACT

According to aspects of the embodiments, there is provided an adaptive blade lubrication apparatus that includes a lubricant unit to place a lubrication stripe of lubricating material on a portion of a main surface; a cleaning blade that engages the main surface to remove excess toner thereon; and a controller configured to control the location of each lubrication stripe of lubricating material, wherein the controller places the lubricating material based on at least one of application frequency, blade lubrication state, blade engagement with the main surface. By varying the location of the lubrication stripe, the cleaning blade is better lubricated over the entire surface of the photoreceptor with the same or less lubricant than used in single location lubrication. Blade life and reliability are improved with more effective lubrication of the blade.

20 Claims, 10 Drawing Sheets

PROCESS FOR DEVELOPMENT OF CLEANING BLADE LUBRICATION STRIPES

BACKGROUND

This disclosure relates in general to copier/printers, and more particularly, to cleaning residual toner from an imaging device surface and reducing cleaning blade failure by maintaining a lubricant level to give adequate lubrication.

In a typical electrophotographic printing process, a photoreceptor or photoconductive member is charged to a uniform potential to sensitize the surface thereof. The charged portion of the photoconductive member is exposed to a light image of an original document being reproduced. Exposure of the charged photoconductive member selectively dissipates the charges thereon in the irradiated areas. This process records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. Toner particles attracted from the carrier granules to the latent image form a toner powder image on the photoconductive member. The toner powder image is then transferred from the photoconductive member to a copy sheet. Heating of the toner particles permanently affixes the powder image to the copy sheet. After each transfer process, the toner remaining on the photoconductor is cleaned by a cleaning device.

Blade cleaning is a technique for removing toner and debris from a photoreceptor or photoconductive member. In a typical application, a relatively thin elastomeric blade member is supported adjacent to and transversely across the photoreceptor with a blade edge that chisels or wipes toner from the surface. Toner accumulating adjacent to the blade is transported away from the blade area by a toner transport arrangement or by gravity. Blade cleaning is advantageous over other cleaning systems due to its low cost, small cleaner unit size, low power requirements, and simplicity. However, conventional blade cleaning systems suffer from short life due to failures brought about from interaction with the photoreceptor and toner. The introduction of new blade materials that possess better reliability and enable dramatic life improvements have not been successful. Further, the introduction of photoreceptor surface coatings while improving photoreceptor life typically results in far higher blade wear rates due to friction. Frictional forces cause the blade to stick and slip or chatter as it rubs against the photoreceptor surface. As the blade rubs over the photoreceptor, the blade sticks to the photoreceptor because of static frictional forces. When the sliding friction exceeds static friction, the blade slips over the photoreceptor surface and returns to the resting position. This stick-slip interaction or chatter is a significant cause of blade failure and very disruptive of the printing process.

A lubrication film or lubricating particles between the rubbing surfaces reduces the intensity of the stick-slip (chatter) generated by the relative motion, but adverse interactions with other electrophotographic systems may occur. An analysis of stick-slip behavior as the blade passes over a photoreceptor shows a low frequency once-around strain signature experienced by the blade that is independent of the speed of the photoreceptor. At very low speeds, a higher frequency, lower amplitude strain is observed on top of the low frequency once-around strain signature. This higher frequency strain was associated with stick-slip behavior of the blade tip.

Whenever the higher frequency strain was observed, an audible stick-slip sound was also heard.

A conventional remedial practice is the use of a toner lubrication stripe. The expectation is that the toner lubrication stripe would provide improved blade lubrication as long as there was an amount of toner riding in front of the blade. Another remedial practice is the application of lubrications stripes consisting of lubricants other than toner. These other lubricants may include PMMA, zinc stearate or other stearates, Unilin or other waxes, PTFE or other low surface energy lubricant particles compatible with the electrophotographic system. The lubrication stripe is introduced in the interdocument zone at every predetermined number of prints or cycles. The interdocument zone is typically in a fixed, stationary location on the photoreceptor so that the lubrication stripes are always developed on the same spot. The development frequency of lubrication stripes is also typically fixed, but various schemes have been proposed over the years to develop stripes based on the need for lubrication.

The current lubrication stripe schemes have not significantly improved blade life because of a failure to provide uniform lubrication. Instead of providing uniform improved blade lubrication and lower blade strain, the lubrication effect was evident only at the original location of the lubrication stripe. Even after numerous drum cycles the lubrication remained localized to the original deposit spot and only slowly spread in the process direction. The accumulated lubricant in front of the blade had no apparent effect on cleaning blade strain reduction. The reduction in chatter was localized to the segment of the drum near the lubrication stripe and is not instantly smeared everywhere.

For the reasons stated above, and for other reasons stated below which will become apparent to those skilled in the art upon reading and understanding the present specification there is need in the art for systems, apparatus, and/or methods that increases the reliability of cleaning blades while minimizing lubricant usage.

SUMMARY

According to aspects of the embodiments, there is provided an adaptive blade lubrication apparatus that includes a lubricant unit to place a stripe of lubricating material on a portion of a main surface; a cleaning blade that engages the main surface to remove excess toner thereon; and a controller configured to control the location of each lubrication stripe, wherein the controller places the lubricant based on at least one of development frequency, blade lubrication state, blade engagement with the main surface. By varying the location of the lubrication stripe, the cleaning blade is better lubricated over the entire surface of the photoreceptor with the same or less lubricant than used in single location lubrication. Blade life and reliability are improved with more effective lubrication of the blade.

DETAILED DESCRIPTION

Figure 1:
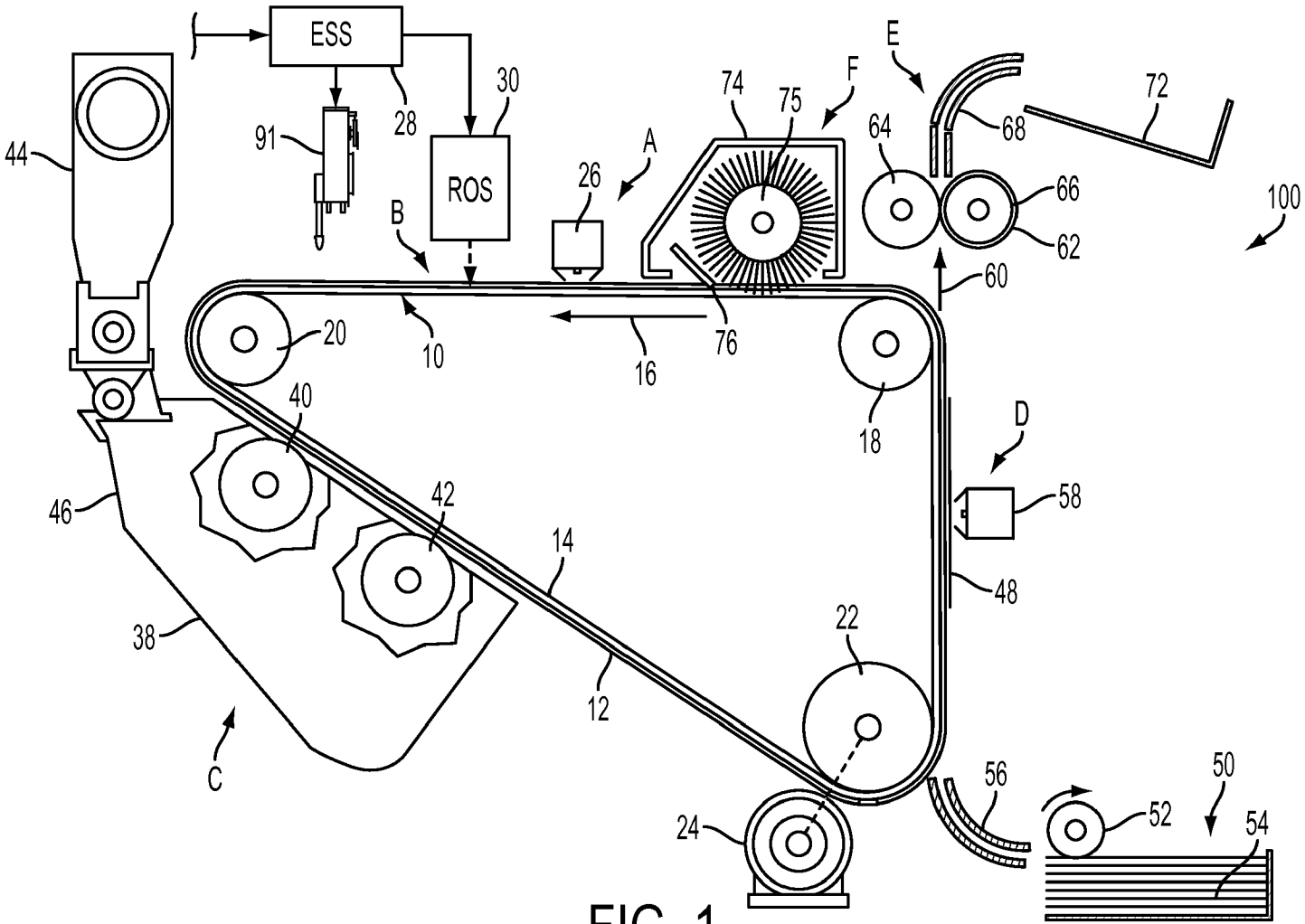
FIG. 1 is a schematic elevational view of an electrophotographic printing machine including an adaptive cleaning blade lubrication apparatus in accordance to an embodiment.

In accordance with aspects of the disclosure, an adaptive blade lubrication apparatus for an electrophotographic machine includes a cleaning blade, a photoreceptor surface, and a controller. The photoreceptor surface receives toner images thereon that pass across the cleaning blade; the cleaning blade wipes toner from the surface thereof. The photoreceptor surface has at least one imaging region of a predetermined size used to image print jobs. The controller may comprise sensors used for estimating at least one of photoreceptor drive motor torque, photoreceptor drive motor electrical parameters, or toner parameters.

The disclosed embodiments include a receptor, movable in a process direction, defining a main surface; a lubricant unit to place at least one lubrication stripe of lubricant material on a portion of the main surface; a cleaning unit, wherein the blade engages the main surface to remove excess toner on the receptor; and, a controller configured to control the location of each lubrication stripe of lubricant material on the portion of the main surface of the receptor.

The disclosed embodiments further include an adaptive blade lubrication apparatus with a controller for placing at least one lubrication stripe of lubricant material on a photoreceptor surface based on at least one of development frequency, blade lubrication state, and blade engagement with the main surface. The lubrication stripe is place on the photoreceptor surface at selected variable positions or at selected precess positions to insure that friction levels experienced by the blade are minimized.

The disclosed embodiments include an image reproduction machine with a movable toner image bearing member having an image bearing surface; toner image forming devices mounted along a path of movement of the toner image bearing surface for forming a toner image on the movable toner image bearing surface; transfer unit to transfer the toner image from the movable toner image bearing surface onto a print media; and an adaptive cleaner blade lubrication apparatus to clean the movable toner image bearing surface. The adaptive cleaner blade comprises a cleaning unit; a lubricant unit for placing a lubrication stripe of lubricant material on a portion of the movable toner image bearing surface; and a controller configured to control the location of each lubrication stripe of lubricant material on the portion of the movable toner image bearing surface.

In accordance with additional aspects of the disclosure, a method to increase the life of a blade of a residual toner blade cleaning apparatus by performing the steps of contacting a moving photoreceptor surface with the blade at a first point along a path of movement of the moving photoreceptor surface; leaving upstream of contact with the blade at least one lubrication stripe of lubricant material on a portion of the moving photoreceptor surface; and, controlling the location of each lubrication stripe of lubricant material on the portion of the moving photoreceptor surface to reduce the stress produced on the cleaning blade during photoreceptor contact. Controlling lubrication stripe at selected precess positions or at selected variable positions on the main surface will have an impact on machine productivity and lubricant usage.

Embodiments as disclosed herein may also include computer-readable media for carrying or having computer-executable instructions or data structures stored thereon for operating such devices as controllers, sensors, and eletromechanical devices. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable media.

The term "print media" generally refers to a usually flexible, sometimes curled, physical sheet of paper, plastic, or other suitable physical print media substrate for images, whether precut or web fed.

The term "image reproduction machine" as used herein refers to a digital copier or printer, electrographic printer, bookmaking machine, facsimile machine, multi-function machine, or the like and can include several marking engines, as well as other print media processing units, such as paper feeders, finishers, and the like. The term "electrographic printer," is intended to encompass image reproduction machines, electrophotographic printers and copiers that employ dry toner developed on an electrophotographic receiver element.

FIG. 1 schematically illustrates an electrophotographic printing machine 100, such as a digital copier, which generally employs a photoreceptor 10, such as a drum or belt, having a photoconductive surface 12 deposited on a conductive ground layer 14. Preferably, photoconductive surface 12 is made from a photoresponsive material, for example, one comprising a charge generation layer and a transport layer. Photoreceptor 10 moves in the direction of arrow 16 to advance successive portions of the photoreceptor sequentially through the various processing stations disposed about the path of movement thereof.

Photoreceptor 10, shown in the form of a belt, may be entrained about stripping roller 18, tensioning roller 20, and drive roller 22. Drive roller 22 is driven by motor 24 to advance photoreceptor 10 in the direction of arrow 16. Photoreceptor 10 may be maintained in tension by a pair of springs (not shown) resiliently urging tensioning roller 20 against photoreceptor 10 with a desired spring force. Stripping roller 18 and tensioning roller 20 may be mounted to rotate freely.

Initially, a portion of photoreceptor 10 passes through charging station A. At charging station A, a corona generating device, indicated generally by the reference numeral 26 charges the photoconductive surface 12 to a relatively high, substantially uniform potential. After photoconductive surface 12 of photoreceptor 10 is charged, the charged portion thereof is advanced through exposure station B.

At an exposure station, B, a controller or electronic subsystem (ESS), indicated generally by reference numeral 28, receives the image signals representing the desired output image and processes these signals to convert them to a continuous tone or grayscale rendition of the image, which is transmitted to a modulated output generator, for example the raster output scanner (ROS), indicated generally by reference numeral 30. The image signals transmitted to ESS 28 may originate from a computer, thereby enabling the electrophotographic printing machine to serve as a remotely located printer for one or more computers. Alternatively, the printer may serve as a dedicated printer for a high-speed computer.

The signals from ESS 28, corresponding to an image desired to be reproduced by the printing machine, are transmitted to ROS 30. ROS 30 includes a laser with rotating polygon mirror blocks. The ROS illuminates the charged portion of photoconductive belt 10 at a suitable resolution. The ROS exposes the photoconductive belt to record an electrostatic latent image thereon corresponding to the image received from ESS 28. As an alternative, ROS 30 may employ a linear array of light emitting diodes (LEDs) arranged to illuminate the charged portion of photoconductive belt 10 on a raster-by-raster basis.

ESS 28 may be connected to a raster input scanner (RIS). The RIS may have document illumination lamps, optics, a scanning drive, and photosensing elements, such as an array of charge coupled devices (CCD) to capture an entire image from an original document and convert it to a series of raster scan lines that are transmitted as electrical signals to ESS 28. ESS 28 processes the signals received from the RIS and converts them to grayscale image intensity signals that are then transmitted to ROS 30. ROS 30 exposes the charged portion of the photoconductive belt to record an electrostatic latent image thereon corresponding to the grayscale image signals received from ESS 28.

After the electrostatic latent image has been recorded on photoconductive surface 12, photoreceptor 10 advances the latent image to a development station, C, where toner is electrostatically attracted to the latent image. As shown, at development station C, a magnetic brush development system, indicated by reference numeral 38, advances developer material into contact with the latent image. Magnetic brush development system 38 includes at least one magnetic brush developer, such as rollers 40 and 42 shown. Rollers 40 and 42 advance developer material into contact with the latent image. These developer rollers form a brush of carrier granules and toner particles extending outwardly from the brush. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38. In the illustrated embodiment, the toner placed by the development system 38, in combination with a special latent image created on the photoreceptor 10 by the exposure ROS 30, serves as the lubricant, and thus the development system and exposure system can together be considered a lubricant unit in accordance to an embodiment. In other possible embodiments, a separate device 91 such as an auger disposed along the path of the photoreceptor 270 can provide lubricant in small amounts as needed. ESS 28 is configured to control the separate device 91 so as to apply the lubricant to the image bearing member at a predetermined time. Suitable lubricant material may be made of a solid, liquid, powdery or similar lubricant material. The solid lubricant may be made from zinc stearate or similar fatty acid metal salt, polyolefin resin, silicone grease, fluorine grease, paraffin wax, graphite, or molybdenum disulfide. A liquid lubricant may be silicone oil, fluorine oil, or the like. A powdery lubricant may be the powder of the above solid lubricant. The liquid, solid or powdery lubricant may be used alone or in combination.

With continued reference to FIG. 1, after the electrostatic latent image is developed, the toner powder image present on photoreceptor 10 advances to transfer station DA print media 48 is advanced to the transfer station, D, by a media feeding apparatus, 50. Media feeding apparatus 50 may include a feed roll 52 contacting the uppermost media of stack 54. Feed roll 52 rotates to advance the uppermost media from stack 54 into chute 56. Chute 56 directs the advancing media of support material into contact with photoconductive surface 12 of belt 10 in a timed sequence so that the toner powder image formed thereon contacts the advancing media at transfer station D. Transfer station D may include a corona generating device 58 that sprays ions onto the back side of media 48. This attracts the toner powder image from photoconductive surface 12 to media 48. After transfer, media 48 continues to move in the direction of arrow 60 onto a conveyor (not shown), which advances media 48 to fusing station E.

Fusing station E includes a fuser assembly, indicated generally by the reference numeral 62, which permanently affixes the transferred powder image to media 48. Fuser assembly 62 includes a heated fuser roller 64 and a back-up roller 66. Media 48 passes between fuser roller 64 and back-up roller 66 with the toner powder image contacting fuser roller 64. In this manner, the toner powder image is permanently affixed to media 48. After fusing, media 48 advances through chute 68 to catch tray 72 for subsequent removal from the printing machine by the operator.

After the print media is separated from photoconductive surface 12 of belt 10, the residual toner/developer and any paper fiber particles adhering to photoconductive surface 12 are cleaned at cleaning station F. Cleaning station F will include a housing 74 and may contain a rotatably mounted fibrous brush 75 in contact with photoconductive surface 12 to disturb and remove paper fibers and cleaning blade 76 to remove the non-transferred toner particles. The cleaning blade 76 may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

Figure 2:
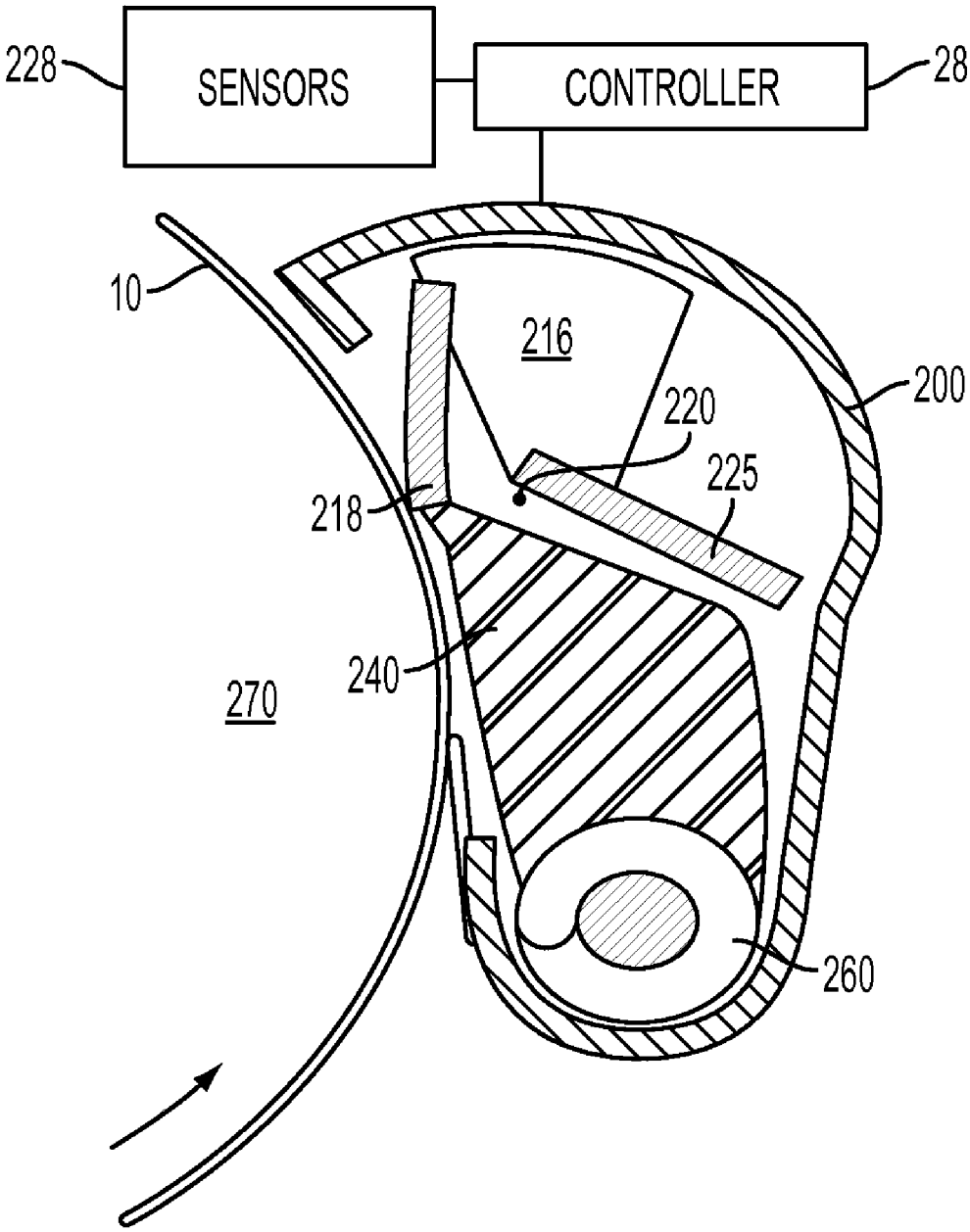
FIG. 2 is a view of a cleaning unit and a receptor movable in a process direction for adaptive blade lubrication in accordance to an embodiment.

FIG. 2 is a view of cleaning unit 200 and Photoreceptor 10 movable in a process direction for adaptive blade lubrication in accordance to an embodiment. Cleaning unit 200 is an exploded view of a portion of cleaning station 74 depicted in FIG. 1. The cleaning unit 200 is in operational contact with a photoreceptor 10 that is moved by drum 270, and houses a blade holder 216, which in turn has a first blade 218 and a second blade 225 attached thereto. The blade holder 216 pivots about a pivot point 220 to position the first or second blade against the surface of the photoreceptor 10, which has a direction of rotation indicated by the arrow at the bottom of the photoreceptor 10 (e.g., counterclockwise in this example). The blade, when placed against the surface of the photoreceptor 10, removes excess waste toner 240, which is directed toward a toner removal auger 260 that removes the waste toner 240 from the cleaner unit 200. Waste toner 240 may then be discarded, recycled, or the like.

The system further comprises a sensor 228 that senses status information related to print quality, toner build-up, blade wear, or any other suitable parameter for determining an appropriate corrective action. The sensor can comprise one or more counters that facilitate determining when to take corrective action such as applying a lubrication stripe. An actuator (Not shown) can be included to facilitate the movement of the blade 218 to engage or disengage contact between the blade 218 and the photoreceptor 10. The photoreceptor surface can be stationary or moving backwards from normal operation during blade replacement. The sensor 228 detects accumulated blade use in one or more ways. For instance, a counter (not shown) or a software module can be programmed to measure or derive blade use as a function of a number of prints and/or as a function of photoreceptor cycles.

Additionally, the controller or ESS 28 can measure blade use as a function of accumulated stress. For instance, the sensor 228 can measure blade friction force. In one example, the sensor includes a force transducer (not shown) such as a strain gage mounted to the blade holder. In another example, the sensor 228 measures photoreceptor drive torque, receptor drive motor torque, receptor drive motor electrical parameters, toner parameters and instruction in controller 28 to measure photoreceptor cycles or prints and a counter or other digital logic to sum friction force times photoreceptor cycles or prints. In still another example, the controller or ESS 28 measures blade use as a function of image pixels. In this example, the sensor 228 includes a counter to sum pixels across the process width, and one or more counters to sum pixels in designated process direction bands.

According to other features, the sensor 228 detects cleaning failures, such as cleaning defects on the output image, toner streaks past the cleaning blade edge on the photoreceptor surface. In this example, the sensor can comprise full width arrays of microdensitometers or the like, which monitor the photoreceptor surface in real time (e.g., without requiring multiple passes over the photoreceptor surface). Other measurements scenarios based on blade use can be accommodated with the appropriate sensor.

Figure 3:
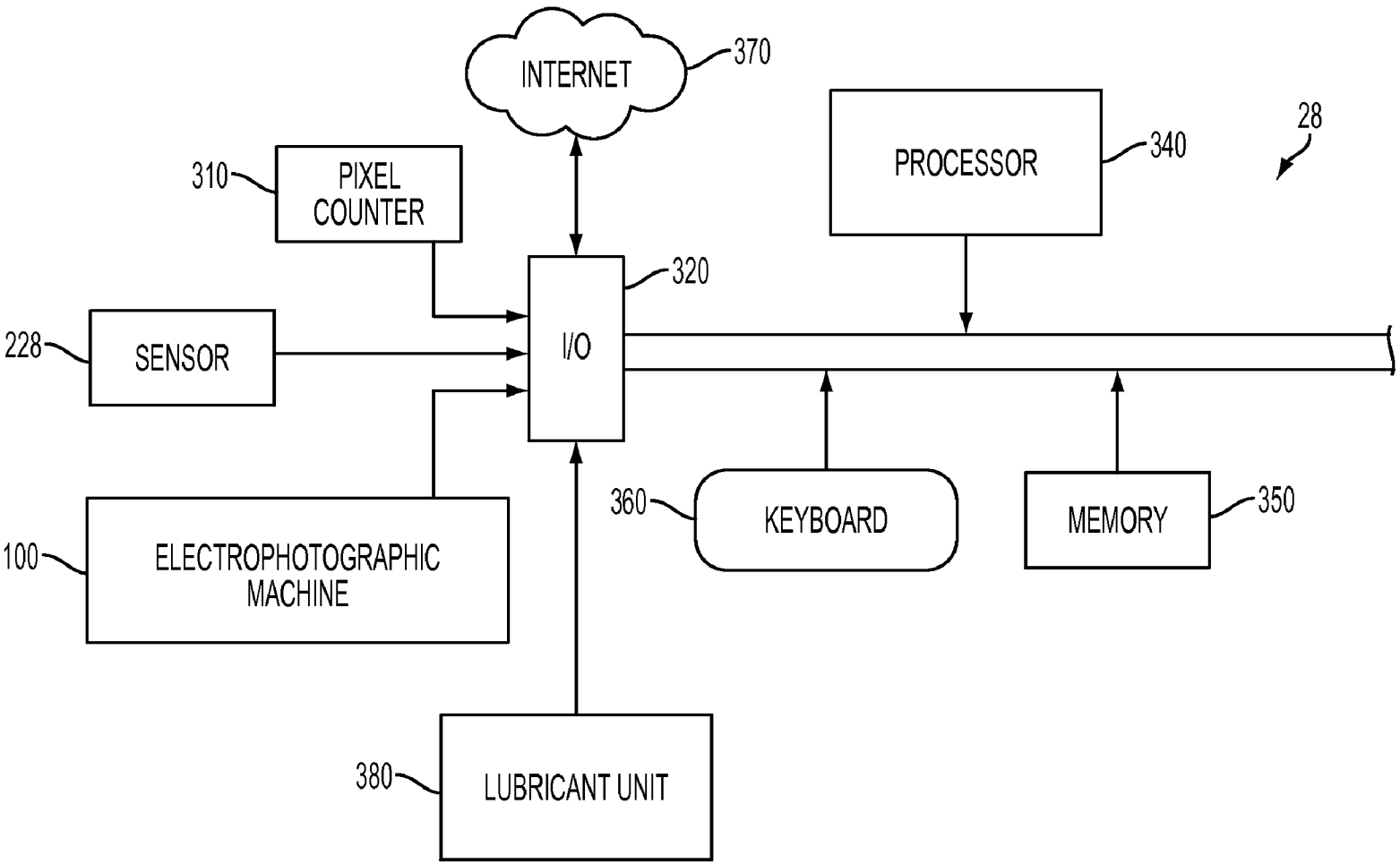
FIG. 3 is a block diagram of an exemplary controller for adaptive blade lubrication in accordance to an embodiment.

FIG. 3 is a block diagram of an exemplary controller 28 for adaptive blade lubrication in accordance to an embodiment. Controller 28 includes a processor 340, input/output (I/O) device 320 for receiving input values pertinent to calculations and determinations from sensor 228 and pixel counter 310, memory 350 for storing inputted variables and various constants or computed values to determine what, if any, corrective action to take and outputs an instruction to the electrophotographic printing machine 100 to cause a corrective action to be performed by the machine or cause lubricant unit 380 to apply a lubricant stripe. Lubricant unit 380 may be the Development Station C of the electrophotographic printing machine 100 that develops toner lubrication stripes or may be a separate unit designed to apply lubricant stripes of other lubricating materials. Inputs to I/O 320 may include values stored in memory 350, such as constants and formulas/equations, and external machine inputs, such as pixel counts to store a pixel count of the images being printed during each print job. In accordance with the amount of the lubricant stripe to be applied onto the surface of the photoreceptor 10 determined by processor 340, the processor 340 controls the lubricant unit 380 to adjust a time and position of the lubricant stripe with the cleaning blade.

The controller 28 uses software or computer-readable media (not shown) for timing control and movement of cleaning blade and lubricant unit 380. The controller and other controllers can form part of a workflow production system of a printer system which uses paper job requests, also known as paper job tickets, which are readable both by a human operator and by a controller. Specifications for the performance of tasks of a workflow that need to be performed by machines and a human operator (user) operating the machines are printed on a paper job request together with additional machine readable markings. The human operator performs the tasks, e.g., setting machine parameters or selectable settings, as specified on the paper job request, and marks the paper job request, as in a traditional work flow, with indications of the state of the task. The marked paper job request is scanned by a scanning device and the machine readable markings are interpreted by a workflow server managing the electronic job request. Controller 28 and other controllers also include an operating system (not shown) that is stored on a computer-accessible media such as RAM, ROM, and mass storage device, and is executed by a processor in a controller. Examples of operating systems include Microsoft Windows®, Apple MacOS®, Linux®, and UNIX®. Examples are not limited to any particular operating system, however, and the construction and use of such operating systems are well known within the art. A user enters commands and information into the controller 28 through input devices such as a keyboard 360 or a pointing device (Not Shown). The keyboard 360 permits entry of textual information into controller 28, as known within the art, and embodiments are not limited to any particular type of keyboard. Controller 28 can have at least one web browser application program executing within at least one operating system, to permit users of controller 28 to access an intranet, extranet or Internet 370 worldwide-web pages as addressed by Universal Resource Locator (URL) addresses. Examples of browser application programs include Mozilla® and Microsoft Internet Explorer®.

Figure 4:
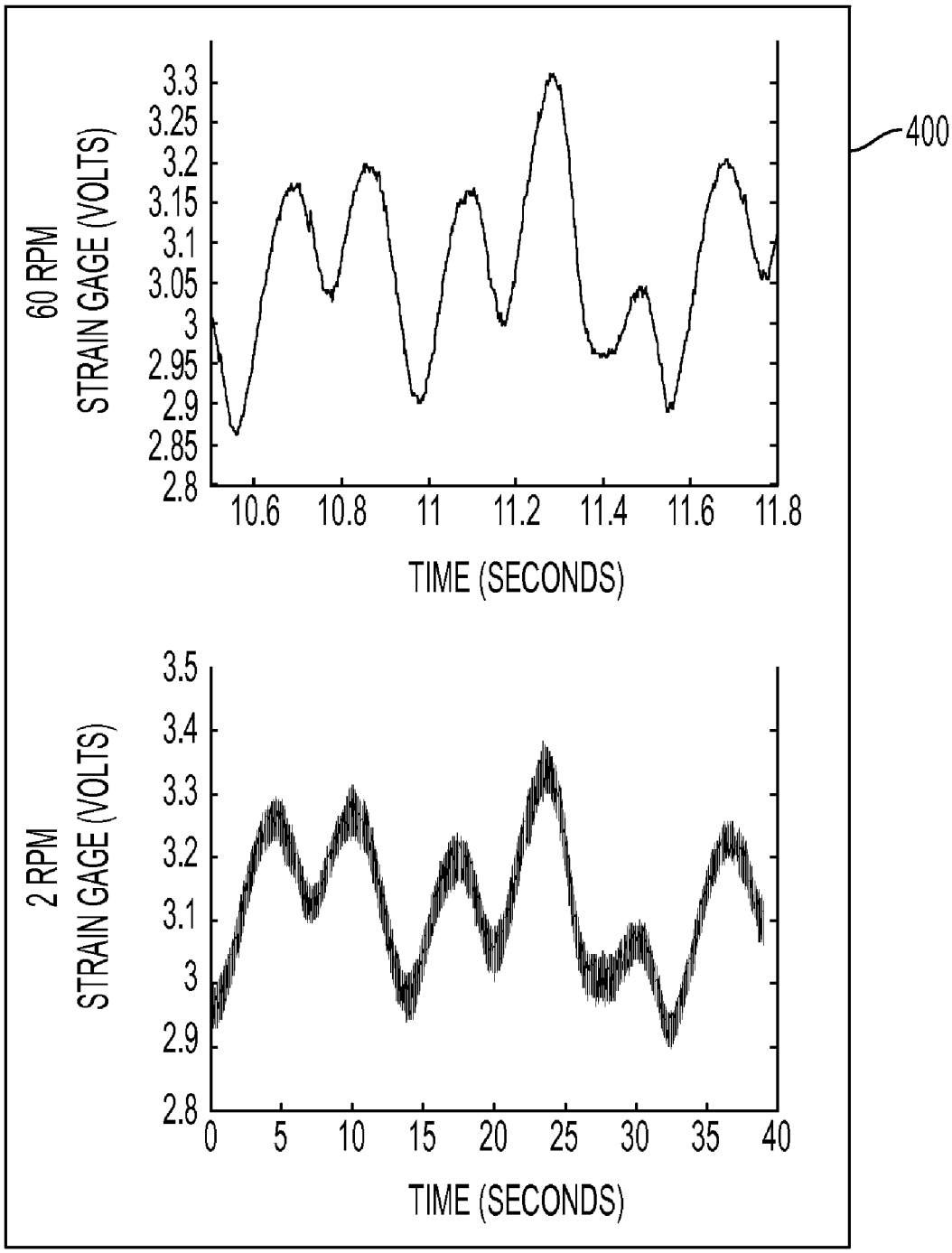
FIG. 4 is an illustration of the high frequency signature and the low frequency once-around signature from stick-slip motion in accordance to an embodiment.

FIG. 4 is an illustration of the high frequency signature and the low frequency once-around signature 400 from stick-slip motion in accordance to an embodiment. A strain gage output reveals a repeating pattern around the photoreceptor. A different repeating pattern was found on a different photoreceptor. When the original photoreceptor was replaced, the first repeating pattern returned. The repeating pattern remained independent of the speed of the photoreceptor. At very low speeds (2 RPM), a higher frequency, lower amplitude strain was observed on top of the low frequency once-around strain signature. This high frequency strain was associated with stick-slip behavior of the blade tip. Whenever the high frequency strain was observed an audible stick-slip sound was also heard. When the cleaning blade 218 makes a contact with the photoreceptor 10 under pressure to clean the toner, the cleaning blade 218 deforms due to the force of friction and stress is developed in the cleaning blade. If the stress is less than the force of static friction between the cleaning blade 218 and the photoreceptor 10, the cleaning blade is coupled to the photoreceptor and there is no slippage. The cleaning blade 218 deforms or sticks in a direction of advancement of the photoreceptor 10. The deformation in the stick is stored as energy in the edge of the cleaning blade 218. If the energy stored becomes greater than the force of friction that energy becomes effective as a restoring force and tries to return to the original state. This force causes the cleaning blade to deform in the opposite direction or to slip. The patterns are repeated alternately when the cleaning blade 218 is in contact with the photoreceptor 10 and this why it is known as the stick-slip phenomenon.

Figure 5:
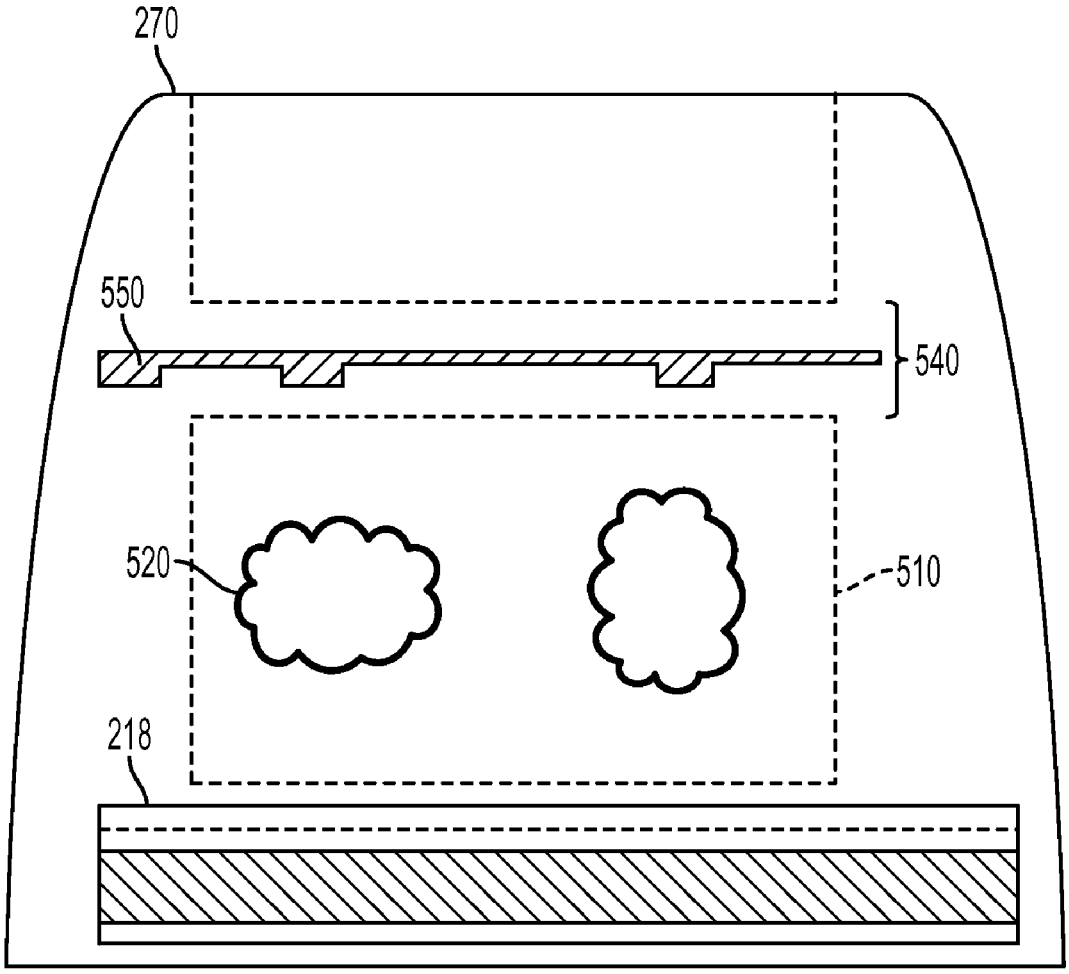
FIG. 5 illustrates the placement of a lubrication stripe as applied to a photoreceptor in accordance to an embodiment.

FIG. 5 illustrates the placement of a lubrication stripe as applied to a photoreceptor in accordance to an embodiment. The cleaning blade 218 is shown in its relationship to a print media 510 shown as a standard sheet size as indicated by the outlines The residual toner 520 acts as a lubricant for cleaning blade 218 and in particular prevents the tip of the cleaning blade from tucking under which can cause streaking and/or damage to cleaning blade 218 or photoreceptor/drum 270. However, it can be seen that in the area where there is not a residual toner 520 there is substantially an absence of toner and blade lubrication. In order to limit the stress on cleaning blade 218 a lubricant stripe 550, as shown the width of the photoreceptor, is placed between the interdocument gap 540. The width and position of the lubrication stripe 550 can be based on sensor data as described in FIG. 2 with reference to sensor 228. Generally, in a typical digital printer there are a discrete number of possible spots or pixels which may be either developed with toner or undeveloped across the width (fast scan direction) of the photoreceptor. There may be N or more of these pixels per inch depending on the resolution of the printer. To calculate the amount of residual toner that will be available for blade lubrication, the number of developed pixels in each location across the width of the photoreceptor is counted for a certain distance in the process direction. Based on this pixel count for each pixel width the amount of available toner for lubrication is then known based on the transfer efficiency of the particular machine. In areas across the width with little or no image data, the lubrication band is then made thicker so as to assure proper blade lubrication. In actual implementation it may only be necessary to count pixels over several areas across the photoreceptor to reduce the number of counters required.

The lubrication stripe has to be distributed in such a way that the cleaning blade is lubricated and there is no substantial interference with the printing process. Some potential strategies that address these goals are: (a) placing a single stationary stripe ("SSS") is the application of a single lubricant stripe in the interdocument zone every predetermined number of prints or cycles; (b) placing two stationary stripes ("TSS") is the application, during the same revolution, of two stripes placed at 180 degrees apart from each other; (c) placing a single stripe precess ("SSP") is the application of a single stripe where the next stripe is placed laterally and upstream from the previous stripe; (d) placing two precess stripes ("TPS") two lubricant stripes are applied and the stripes are precessed; (e) placing three precess stripes ("THPS") three lubricant stripes are applied with one third the density and each stripe is precess; and (f) spreading N lubrication stripes ("NLS") evenly on the photoreceptor. In order to illustrate the effectiveness of various lubrication stripe strategies the photoreceptor is divided into N cells. The lubrication level for each cell is measured, stored, and quantified. On each revolution of the photoreceptor drum, the cleaning blade pushes a percentage of the lubricant in a specified cell into the next downstream cell and the specified cell receives lubricant from the upstream cell. In addition, the specified cell loses a percentage of its lubricant during each revolution of the photoreceptor. The lubricant is lost to development scavenging, transfer and blade cleaning.

Figure 6:
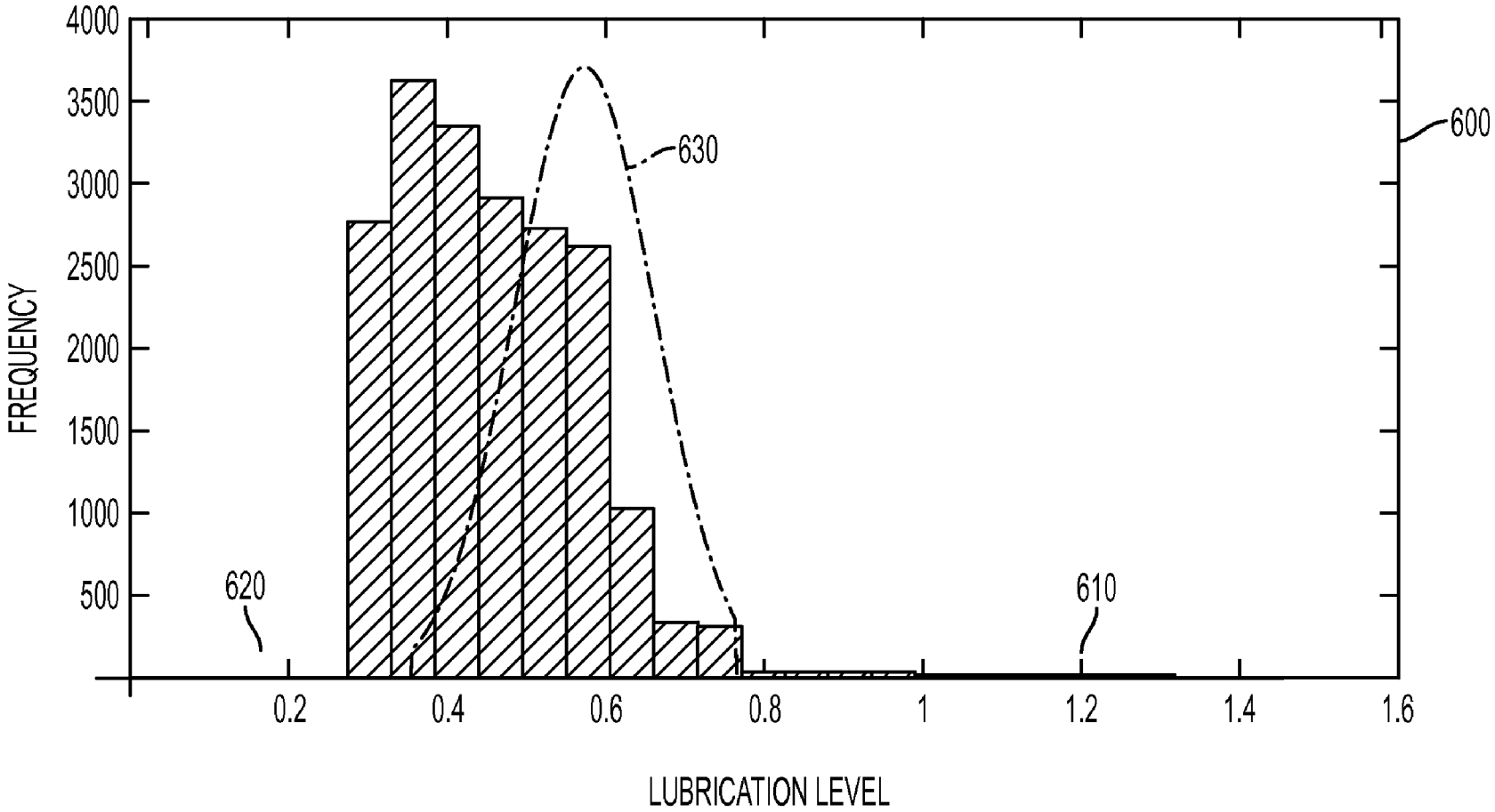
FIG. 6 is a histogram of photoreceptor lubrication levels for single stationary stripe in accordance to an embodiment.

FIG. 6 is a histogram of photoreceptor lubrication levels for single stationary stripe in accordance to an embodiment. The histogram shows lubrication levels for a scenario where the stripe is persistently placed in the interdocument zone every predetermined number of prints or cycles. The interdocument zone is typically in a fixed, stationary location on the photoreceptor. The interdocument zone insures that the lubrication stripe is always applied on the same spot. The application frequency of lubrication stripes is also typically fixed, but various schemes have been proposed over the years to apply stripes based on the need for lubrication. The need for lubrication could be determined based on a measurement of blade lubrication state such as photoreceptor drive motor torque, electrical parameters (current or voltage), toner input to the blade (e.g., pixel counting to determine document area coverage). In the single stationary stripe case the photoreceptor surface is extremely well lubricated at the site of lubrication stripe application like the interdocument zone. Then, as the photoreceptor rotates, lubrication is slowly spread downstream from the original site of lubrication stripe application. The location on the photoreceptor surface just upstream from the site of lubrication stripe application is the last spot to feel the effect of lubrication. In FIG. 6, the histogram shows a very long thin tail 610 of high lubrication (possibly saturated) that would coincide with the stationary location of lubricant stripe application. The majority of the photoreceptor surface receives much less lubrication. The left side of the distribution 620 represents substantial lower lubrication levels. This is where the cleaning blade experiences an increase in wear and degradation. An improved lubrication distribution moves the left side of the distribution to the right. An ideal distribution 630 would be a very narrow distribution located at the lubrication level that is just saturated and not higher or lower. In the ideal world all of the photoreceptor surface would be lubricated to the same high level for long blade life, but none would be lubricated beyond the saturation level so that lubricant is wasted. A single stationary stripe strategy that chooses the same position and the same lubricant stripe application cycle produces the spotty distribution shown with saturation (610) in certain areas and starvation (620) in others. This strategy can be improved by placing the lubrication stripe at a selected variable position on the main surface. The subsequent positions could be changed upstream, downstream, or in a precessed manner.

Figure 7:
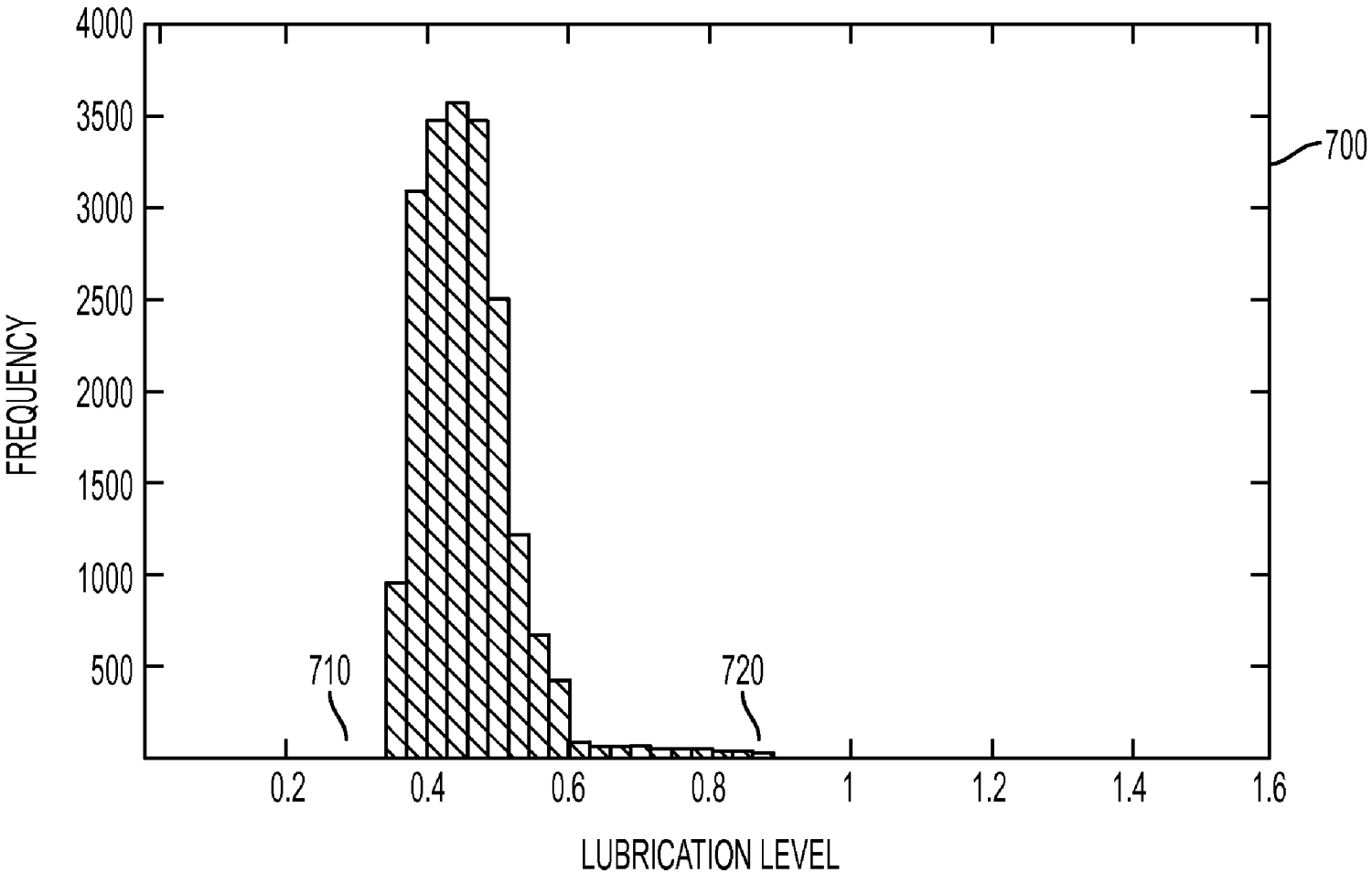
FIG. 7 is a histogram of photoreceptor lubrication levels for two stationary stripes in accordance to an embodiment.

FIG. 7 is a histogram 700 of photoreceptor lubrication levels for two stationary stripes in accordance to an embodiment. In this case, two lubrication stripes are applied during the same revolution of the photoreceptor drum. The stripes are N° (up to 180 degrees) apart on the drum and each half the applied density of the single lubrication stripe in single stationary stripe ("SSS"). As in SSS, each stripe is always applied onto its own location on the photoreceptor surface. FIG. 7 shows a histogram of the lubrication levels present on the surface of the photoreceptor after substantially steady state lubrication conditions have been achieved. The high lubrication tail 720 distribution is not as long as the tail in the SSS scenario. The low lubrication side 710 distribution is higher than the low end of the single stationary stripe distribution. By developing the same amount of the lubricant as in the SSS scenario onto two stationary photoreceptor locations, the lowest level of lubrication in the two stationary stripe ("TSS") scenarios increased over the lowest level in SSS. Blades wearing in SSS lubrication conditions would experience more friction stresses than blades wearing in TSS lubrication conditions. The cleaning blade in the TSS scenario would wear at a slower rate than the SSS cleaning blade.

Figure 8:
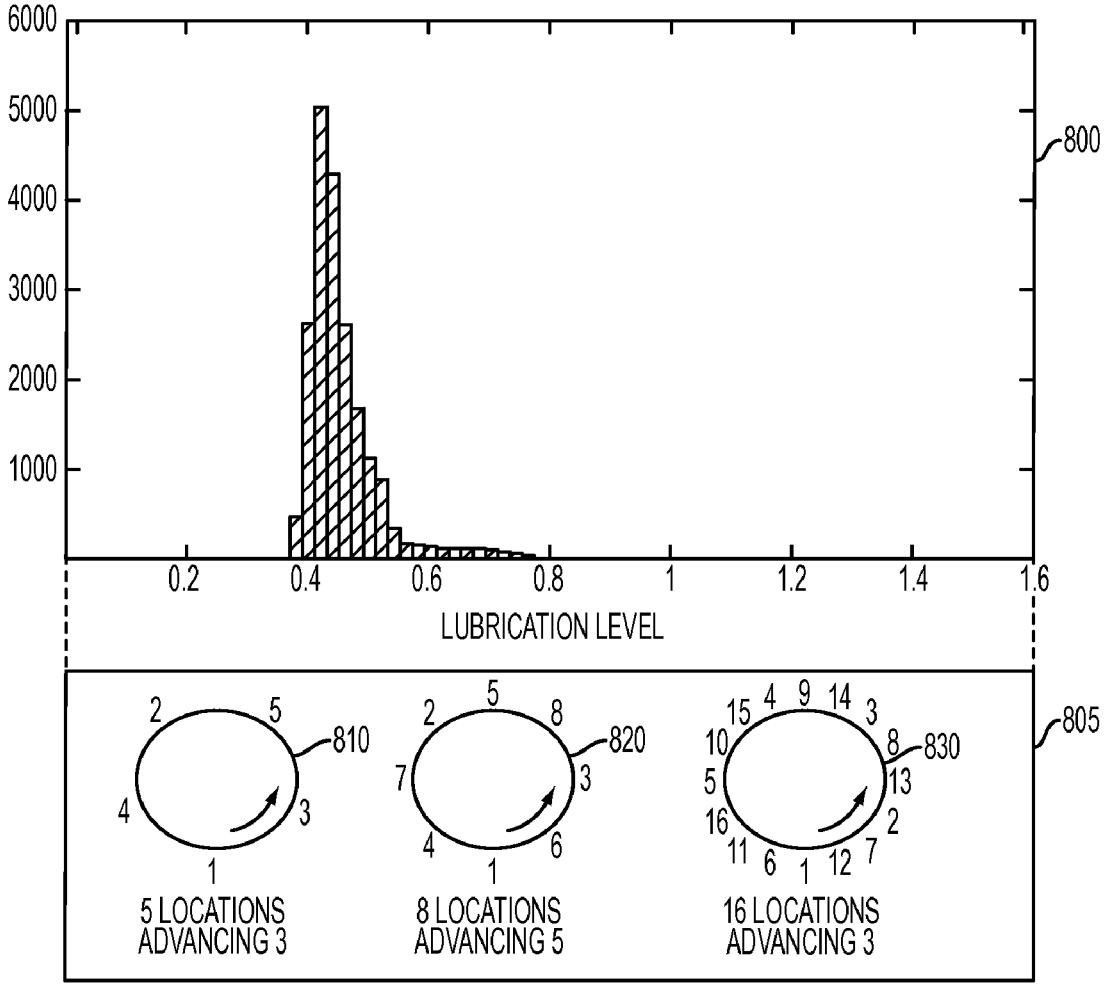
FIG. 8 is a histogram of photoreceptor lubrication levels for multiple precess stripes and lubrication stripe development location precession methods in accordance to an embodiment.

FIG. 8 is a histogram 800 of photoreceptor lubrication levels for multiple precess stripes and lubrication stripe application location precession methods in accordance to an embodiment. The lubrication stripe precession methods 805 is shown for five (5) locations 810, eight (8) locations 820, and sixteen (16) locations 830. Positions are shown when the lubrication stripe is advanced in a counter clockwise direction three through five positions. The method of precession is chosen so that application location of the lubrication stripe varies. Many methods of precession are possible, but the idea is to substantially cover the surface of the photoreceptor with lubrication stripe application locations before returning to the first application location and repeating the application pattern.

The histogram 800 shows the lubrication levels present on the surface of the photoreceptor after substantially steady state lubrication conditions have been achieved for a is to a single stripe precess. The high lubrication distribution tail shown is not as long as the tails in the single stationary stripe or the two stationary stripes. The low lubrication side distribution is similar to the low end of the two stationary stripe distribution. In the single stripe precess the cleaning blade would also wear at a slower rate than in the single stationary stripe cleaning blade.

In the case of the two lubrication precess stripe, the stripes are applied with half the density of the single stationary stripe. The precession method used is the same as the one used in the single precess stripe. This case is a combination of TSS and SSP. The tail in the histogram (Not shown) is not as long as the tail for the single stationary stripe but is similar to the two stationary stripe scenario. The low lubrication side of the TPS distribution is similar to the low end of the two stationary stripe distribution. In the TPS scenario the cleaning blade would also wear at a slower rate than the single stationary stripe.

In the three lubrication stripes or THPS are applied with one third the density of the single stripe in SSS and the stripes are precessed. The precession method used is the same used in SSP. The histogram of the lubrication levels (Not Shown) shows the high lubrication tail in the distribution is shorter than the high lubrication levels in any of the earlier cases. The low lubrication side of the THPS distribution is similar to the low end of the TPS scenario distribution.

In the N lubrication stripes or NLS case lubrication stripes are applied onto each of the N cells of the surface of the photoreceptor. The applied lubricant density of each stripe is one $N^{th}$ (1/N) the density of the single stripe in single stationary stripe. Because the surface of the photoreceptor is completely coated with lubrication there is no need for precession. The histogram (Not shown) of the lubrication levels shows that the high lubrication tail distribution is the shortest of all the cases. The low lubrication side of the NLS distribution is also better than any of the other distributions. The NLS toner lubrication distribution is narrower than all of the other cases. The cleaning blade would have the least amount of wear of all the enumerated scenarios.

Figure 9:
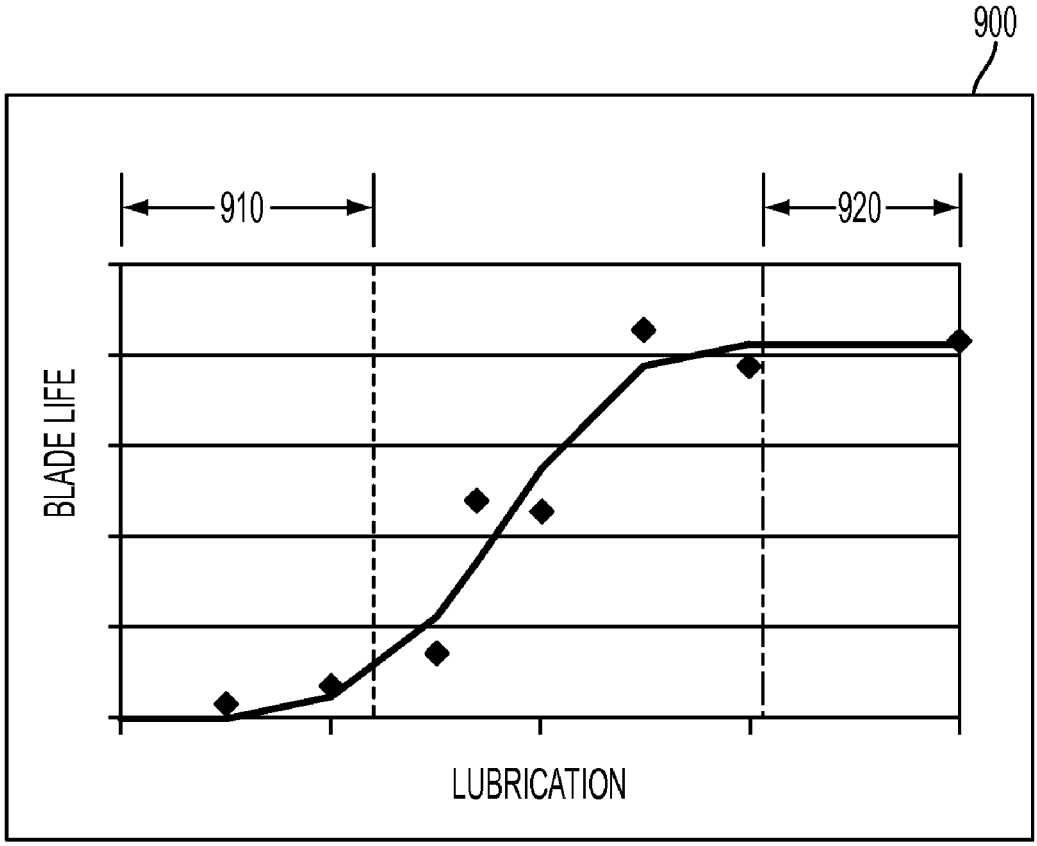
FIG. 9 illustrates blade life as a function of toner lubrication level in accordance to an embodiment.

FIG. 9 illustrates blade life 900 as a function of toner lubrication level in accordance to an embodiment. In comparing the different scenarios, the important point to remember is that the life of the cleaning blade is determined by the low lubrication end of the lubrication distribution. Very low lubrication levels 910 rapidly wear blade edges. Saturation can occur at high lubrication levels (920), where increasing the amount of toner lubrication results in little or no reduction in blade wear. The lubrication cases can be compared by selecting a metric that describes the low lubrication end of the lubrication distribution. For example, the different scenarios could be compared by selecting the lubrication level that bounds the lowest ten percent (10%) or some other appropriate percentage. The lowest 10% bounds for each scenario can then be compared and the scenario with the highest 10% bound would then be selected for that imaging device. Higher 10% bound lubrication values indicate more lubrication at the low end of the lubrication distribution and longer blade life. The N lubrication stripe (NLS), where the lubrication is spread evenly over the photoreceptor surface, is the best lubricated case. The two precess stripe (TPS) and the three precess stripe (THPS) are similar and not as well lubricated as N lubrication stripe. The two stationary stripe and the single stripe precess are also quite similar and not as well lubricated as TPS and THPS. The worst lubricated case is the single stationary stripe.

Another metric that can be used to select a lubrication strategy is the lubrication threshold. A lubrication threshold value is chosen that is known to be important to achieving the desired blade life or is an arbitrary value useful for relative comparisons or selection. The selection is made between scenarios by determining the proportion of the lubrication distribution for each strategy that is below the lubrication threshold. The lubrication distribution of the best case, NLS, is entirely above the lubrication threshold. SSP and THPS are similar and are not as well lubricated as the NLS. There is difference in that TSP is better lubricated than SSP. All lubrication distributions are better lubricated than the single stationary stripe. Because the lubrication distribution for NLS is entirely above the lubrication threshold, there is a possible opportunity to reduce the lubrication in NLS and still keep the entire lubrication distribution above the lubrication threshold. Reductions in lubrication can be accomplished by reducing the mass of lubricant stripe applied, reducing the size of the lubricant stripe, increasing the photoreceptor cycles between application of lubricant stripes, or spacing the lubricant stripes further apart, i.e., less than fully covered photoreceptor. The advantage of reducing the lubrication level is that lubricant is conserved and machine running costs are reduced. The method of lubrication reduction selected may be determined by how disruptive lubrication stripe application is to the print process. If, for instance, printing is interrupted for a lubrication stripe application cycle, then increasing the number of photoreceptor cycles between lubrication cycles may be more advantageous than decreasing the lubricant mass developed. Selection of the best method for increasing lubrication of the photoreceptor surface is influenced by machine conditions. The toner, blade material, and photoreceptor properties affect the friction experienced by the cleaning blade. Job length, toner band development during cycle-up and cycle-out, print area coverage, and the toner density developed all impact the amount of toner applied to the photoreceptor in addition to lubrication stripes. All of these factors will influence how well a particular lubrication stripe method will lubricate the entire surface of the photoreceptor. In addition, the lubrication stripe method will have an impact on machine productivity and toner or other lubricant usage. Market sensitivity to reductions in productivity and run cost will also influence the chose of lubrication method and type of lubricant. All the scenarios show that the location of the blade lubrication stripe, in the process direction, is extremely important in increasing the cleaning blade edge longevity. Successful maximization of the lubrication stripe location can be used to reduce system run cost by minimizing the lubricant usage from lowering the lubrication density and/or frequency, and by increasing the reliability of the blade. The scenarios outlined in this proposal provide exemplary techniques to ensure blade longevity, while minimizing lubricant usage.

Figure 10:
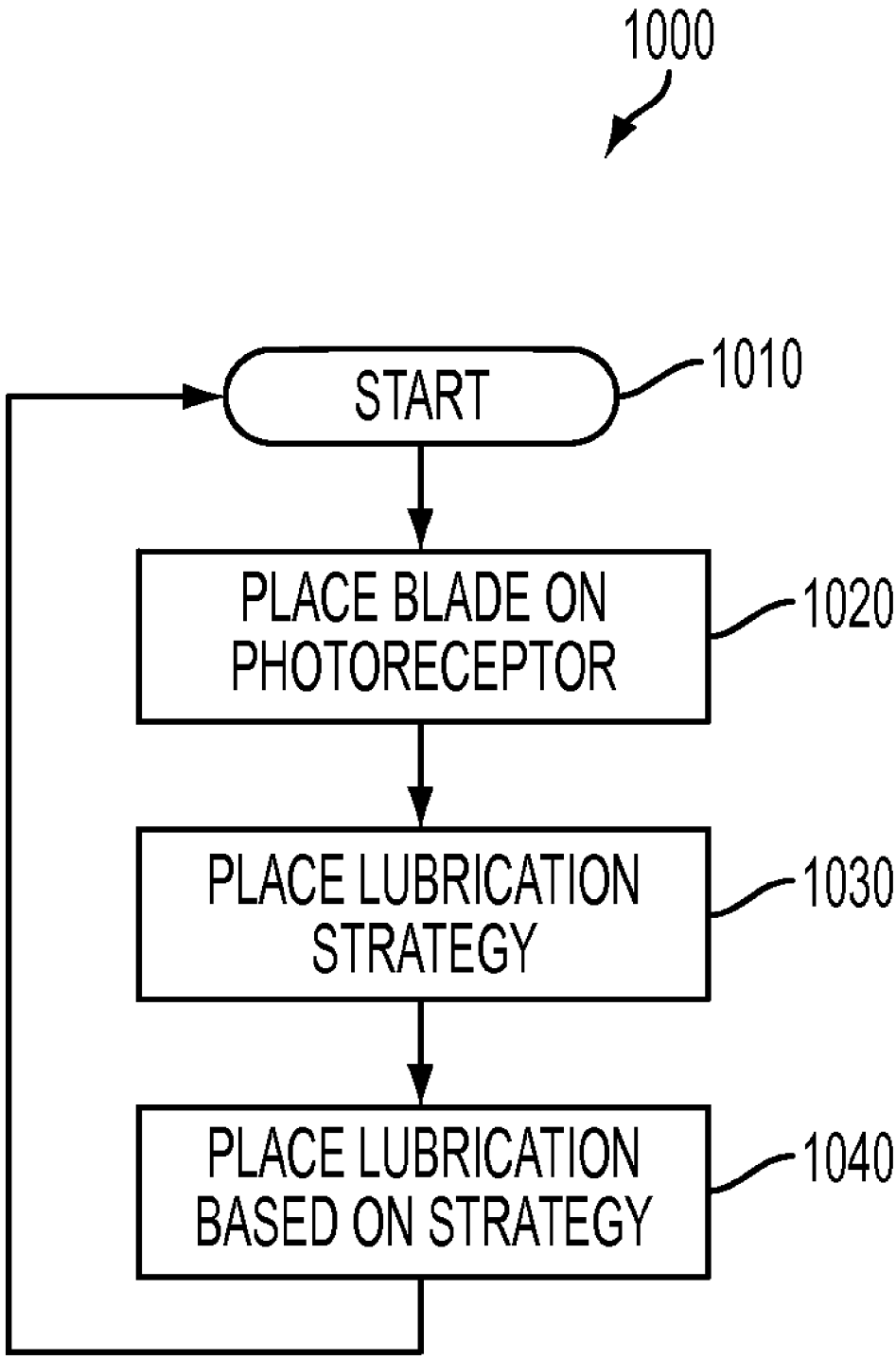
FIG. 10 is a flowchart of a method to increase the life of a cleaning blade in accordance to an embodiment.

FIG. 10 is a flowchart of a method to increase the life of a cleaning blade in accordance to an embodiment. Action 1010 starts the process for selecting a lubrication strategy and controlling of lubrication based on the selected lubrication strategy. In action 1020 the cleaning blade is placed in contact with the photoreceptor. In action 1030 a placement lubrication strategy is selected. The selection can be based on the considerations enumerated above. The selection can be based on machine conditions, toner, blade material and photoreceptor properties affect the friction levels experienced by the blade, job length, and toner band development. In action 1040, at least one lubrication stripe is placed on the photoreceptor based on the place lubrication strategy of action 1020. The lubrication stripe is inclusive of reduction in the mass of lubrication stripe applied, reduction in the size of the lubrication stripe, increase in the photoreceptor cycles between development of lubrication stripes, or spacing the lubrication stripes further apart, i.e., less than fully covered photoreceptor. The placement of the lubrication stripe can be at least one of (a) placing a single stationary stripe ("SSS"); (b) placing two stationary stripes ("TSS"); (c) placing a single stripe precess ("SSP"); (d) placing two precess stripes ("TPS"); (e) placing three precess stripes ("THPS"); and (f) spreading N lubrication stripes ("NLS") evenly on the photoreceptor.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

It is believed that the foregoing description is sufficient for purposes of the present application to illustrate the general operation of an electrophotographic printing machine. Moreover, while the present invention is described in an embodiment of a single color printing system, there is no intent to limit it to such an embodiment. On the contrary, the present invention is intended for use in multi-color printing systems as well, or any other printing system having a cleaner blade and toner. It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the followings claims.

What is claimed is:

1. An adaptive blade lubrication apparatus in a printing system comprising:

a receptor, movable in a process direction, defining a main surface;

a lubricant unit to place at least one lubrication stripe of lubricating material on a portion of the main surface;

a cleaning unit, wherein the blade engages the main surface to remove excess toner on the receptor;

a controller configured to control the location of each lubrication stripe of lubricating material on the portion of the main surface of the receptor.

2. The adaptive blade lubrication apparatus of claim 1, wherein the at least one lubrication stripe of lubricating material is placed on the portion of the main surface based on at least one of application frequency, blade lubrication state, blade engagement with the main surface.

3. The adaptive blade lubrication apparatus of claim 2, wherein blade lubrication state is determined from at least one of receptor drive motor torque, receptor drive motor electrical parameters, toner parameters.

4. The adaptive blade lubrication apparatus of claim 2, wherein the at least one lubrication stripe is N lubrication stripes placed at selected positions on the main surface.

5. The adaptive blade lubrication apparatus of claim 2, wherein the at least one lubrication stripe is two stationary stripes positioned relative to each other at selected variable positions on the main surface.

6. The adaptive blade lubrication apparatus of claim 2, wherein the at least one lubrication stripe is a single stripe placed on the main surface at selected precess positions on the main surface.

7. The adaptive blade lubrication apparatus of claim 2, wherein the at least one lubrication stripe is at least two stationary stripes positioned relative to each other at selected precess positions on the main surface.

8. The adaptive blade lubrication apparatus of claim 2, wherein the controller controls the amount of lubricant to be applied onto the main surface.

9. An image reproduction machine comprising:

a movable toner image bearing member having an image bearing surface;

toner image forming devices mounted along a path of movement of the toner image bearing surface for forming a toner image on the movable toner image bearing surface;

transfer unit to transfer the toner image from the movable toner image bearing surface onto a print media; and an adaptive cleaner blade lubrication apparatus to clean the movable toner image bearing surface comprising:

a cleaning unit, wherein the blade engages the movable toner image bearing surface to remove excess toner;

a lubricant unit to place at least one lubrication stripe of lubricating material on a portion of the movable toner image bearing surface;

a controller configured to control the location of each lubrication stripe of lubricating material on the portion of the movable toner image bearing surface.

10. The image reproduction machine of claim 9, wherein the at least one lubrication stripe of lubricating material is placed on the portion of the movable toner image bearing surface based on at least one of application frequency, blade lubrication state, blade engagement with the main surface.

11. The image reproduction machine of claim 10, wherein blade lubrication state is determined from at least one of receptor drive motor torque, receptor drive motor electrical parameters, toner parameters.

12. The image reproduction machine of claim 10, wherein the at least one lubrication stripe is N lubrication stripes placed at selected positions on the main surface.

13. The image reproduction machine of claim 10, wherein the at least one lubrication stripe is two stationary stripes positioned relative to each other at selected variable positions on the movable toner image bearing surface.

14. The image reproduction machine of claim 10, wherein the at least one lubrication stripe is a single stripe placed on the main surface at selected precess positions on the movable toner image bearing surface.

15. The image reproduction machine of claim 10, wherein the at least one lubrication stripe is at least two stationary stripes positioned relative to each other at selected precess positions on the movable toner image bearing surface.

16. The image reproduction machine of claim 10, wherein the controller controls a lubricant amount to be applied onto the movable toner image bearing surface.

17. A method to increase the life of a blade of a toner blade cleaning apparatus comprising:

contacting a moving photoreceptor surface with the blade at a first point along a path of movement of the moving photoreceptor surface;

controlling the location of each lubrication stripe of lubricating material on the portion of the moving photoreceptor surface; and, leaving upstream of contact with the blade at least one lubrication stripe of lubricating material on a portion of the moving photoreceptor surface based on a lubrication stripe strategy;

wherein wear produced from blade and photoreceptor contact is reduced by varying the location of the at least one lubrication stripe of lubricating material.

18. The method of claim 17, wherein the at least one lubrication stripe of lubricating material is placed on the moving photoreceptor surface based on at least one of application frequency, blade lubrication state, blade contact with the moving photoreceptor surface.

19. The method of claim 18, wherein the lubrication stripe strategy is N lubrication stripes placed at selected positions on the main surface.

20. The method of claim 18, the method further comprising:

controlling an amount of lubricant to be applied onto the moving photoreceptor surface;

wherein a development system develops the lubrication material that is applied to the portion of the moving photoreceptor surface.

* * * * *